US011390422B2

(12) United States Patent
Huizingh et al.

(10) Patent No.: US 11,390,422 B2
(45) Date of Patent: Jul. 19, 2022

(54) PLASTIC PALLET

(71) Applicant: Schoeller Allibert GmbH, Schwerin (DE)

(72) Inventors: Jan Abraham Huizingh, Vlagtwedde (NL); Jan Vinke, Emmer-compascuum (NL)

(73) Assignee: SCHOELLER ALLIBERT GMBH, Schwerin (DE)

( * ) Notice: Subject to any disclaimer, the term of this patent is extended or adjusted under 35 U.S.C. 154(b) by 0 days.

(21) Appl. No.: 16/649,392

(22) PCT Filed: Jun. 29, 2018

(86) PCT No.: PCT/EP2018/067665
§ 371 (c)(1),
(2) Date: Mar. 11, 2021

(87) PCT Pub. No.: WO2019/057358
PCT Pub. Date: Mar. 28, 2019

(65) Prior Publication Data

US 2021/0331830 A1 Oct. 28, 2021

(30) Foreign Application Priority Data

Sep. 20, 2017 (DE) ..... 10 2017 121 813.0

(51) Int. Cl.
*B65D 19/00* (2006.01)
*B65D 19/18* (2006.01)

(52) U.S. Cl.
CPC ..... *B65D 19/0026* (2013.01); *B65D 19/18* (2013.01); *B65D 2519/00034* (2013.01);
(Continued)

(58) Field of Classification Search
CPC .... B65D 19/18; B65D 19/06; B65D 19/0026; B65D 2519/00034; B65D 2519/00273;
(Continued)

(56) References Cited

U.S. PATENT DOCUMENTS 4,635,562 A * 1/1987 Kreeger ..... B65D 19/18 108/55.1
5,402,735 A * 4/1995 DeJean ..... B65D 19/0081 108/56.1

(Continued)

FOREIGN PATENT DOCUMENTS

DE 102008047856 A1 4/2010
EP 1354807 A2 10/2003

(Continued)

OTHER PUBLICATIONS

European Patent Office; International Search Report; dated Aug. 30, 2018.

*Primary Examiner* — Jose V Chen
(74) *Attorney, Agent, or Firm* — Price Heneveld LLP

(57) ABSTRACT

A pallet made of plastic, with a cover plate for holding objects and with at least two, preferably three skids arranged below the cover plate, which are arranged parallel to each other and parallel to a pallet edge and each with a skid standing surface, wherein at the ends of which an angled support leg-like skid member is arranged from the skid base in the direction of the cover plate, the skid base surface being arranged at a distance from the cover plate by the skid support members and support feet arranged therebetween is detachably connected to the latter, the skids each being formed from at least two, preferably one-piece skids which together form a skid of the pallet each releasably connectable to the cover plate and which are in the position mounted on the cover plate.

18 Claims, 7 Drawing Sheets

(52) U.S. Cl.
CPC ..... *B65D 2519/00069* (2013.01); *B65D 2519/0099* (2013.01); *B65D 2519/00139* (2013.01); *B65D 2519/00273* (2013.01); *B65D 2519/00288* (2013.01); *B65D 2519/00323* (2013.01); *B65D 2519/00333* (2013.01); *B65D 2519/00567* (2013.01); *B65D 2519/00572* (2013.01); *B65D 2519/00771* (2013.01); *B65D 2519/00791* (2013.01)

(58) Field of Classification Search
CPC ..... B65D 2519/00368; B65D 2519/00547; B65D 2519/00552
USPC ..... 108/57.25, 57.26, 56.1, 56.3
See application file for complete search history.

(56) References Cited

U.S. PATENT DOCUMENTS 5,413,052 A * 5/1995 Breezer ..... B65D 19/0012 108/56.1
5,845,588 A * 12/1998 Gronnevik ..... B65D 19/0048 108/57.27
6,029,583 A * 2/2000 LeTrudet ..... B65D 19/0012 108/57.25
6,109,190 A * 8/2000 Hale ..... B65D 19/0016 108/57.25
7,578,244 B2 * 8/2009 Williams, Jr. ..... B65D 19/0095 108/56.3
9,108,762 B1 * 8/2015 Lin ..... B65D 19/06
11,186,409 B2 * 11/2021 Wood ..... B65D 19/44
2008/0066657 A1 * 3/2008 Kuo ..... B65D 19/18 108/57.19
2009/0025342 A1 * 1/2009 Ishikawa ..... B65D 19/18 53/447
2009/0212049 A1 * 8/2009 Anhel ..... B65D 19/18 220/4.28
2015/0321837 A1 * 11/2015 Miller ..... B65D 88/54 222/108
2016/0039566 A1 * 2/2016 Lorenz ..... B65D 19/0016 108/57.25
2019/0092521 A1 * 3/2019 Zimmerman ..... B65D 19/0002
2019/0168912 A1 * 6/2019 de Bokx ..... B65D 19/0073
2019/0233162 A1 * 8/2019 Jones ..... B65D 19/0075
2020/0002053 A1 * 1/2020 Zhang ..... B65D 19/0095
2020/0148417 A1 * 5/2020 Daubenspeck ..... B65D 19/38
2020/0207512 A1 * 7/2020 Marconel Carpio ..... B65D 19/0073
2021/0253301 A1 * 8/2021 Turner ..... B65D 19/06
2021/0354876 A1 * 11/2021 Turner ..... B65D 19/06

FOREIGN PATENT DOCUMENTS

ES 1071497 U 3/2010
WO 0176960 A1 10/2001

* cited by examiner

PLASTIC PALLET

BACKGROUND OF THE INVENTION

The invention relates to a pallet made of plastic according to the preamble of claim 1.

As is known, pallets are available on the market which are made either of wood or of plastic, in particular by injection molding. The advantage of the wooden pallet is a certain robustness and low manufacturing costs, however, wooden pallets are increasingly being replaced by plastic pallets, especially for the transport and storage of high-quality goods. On the one hand, this is due to the fact that plastic pallets are now very robust and are usually designed for very long handling and operating times of 10 years and beyond, and that plastic pallets are much less contaminated during use because they can be cleaned quick and thoroughly in a simple manner compared to wooden pallets.

The pallets are available in different standard sizes, especially in sizes of 800×1200 mm, 800×1000 mm, to name just a few standard sizes. In particular, pallets are often used, which are referred to as half-pallets and have standard dimensions of 800×600 mm purely by way of example. These half pallets are particularly suitable in a supplemented way with the standard pallets with a size of 800×1200 mm.

The pallets generally have in common that they are formed on the underside with skids over which the pallet stands on the ground. Usually three skids are used for pallets in the usual standard dimensions, which are arranged parallel to one another and at a distance from one another and parallel to a pallet edge. As a rule, the two outer skids are arranged on two opposite pallet edges and the third skid in the area of the center of the pallet. The adjacent skids on the underside of the cover plate of the pallet delimit engaging openings between them, which facilitate transportation by conventional lifting devices. These engagement openings are used so that tines of forklift trucks or pallet trucks can be inserted under the cover plate of the pallet between the skids, thereby lifting the pallet for transport and placing it again at the desired storage location by lowering it.

On the other hand, the skids are each arranged on support feet at a distance from the cover plate, with three support feet usually being used for each skid. These support feet also form engagement openings between them for the introduction of tines from forklifts or similar lifting devices, so that the pallet can also be gripped and transported on the narrow side of lifting devices. In this respect, it is generally possible to pick up the pallet using common lifting devices by engaging tines from all sides of the pallet.

The problem with the transport of loaded pallets by means of motorized lifting devices or manually operated hand pallet trucks is that the tines frequently hit the skids when the lifting devices are inserted under the pallet or under the upper deck of the pallet, depending on the force or frequency of the impact respectively. Impact can damage the skid area of the pallets. This problem occurs in particular in the case of pallets with reduced standard dimensions, in particular in the case of half-pallets with, for example, standard sizes of 800×600 mm. As a result of the width of the two tines of the lifting devices, there is little scope for the thickness of these support feet for the outer support feet at the pallet edges. This means that the smaller the standard size of the pallet, the less space or thickness is available for the outer support feet, which must be flush with the outside of the pallet edges. This means that, especially for pallets with small standard dimensions, such as half-pallets, the outer support feet must be made comparatively thin or thin-walled, which increases the risk of damage to the skids, i.e. the lower part of the pallet, including the support feet, in these areas.

For this reason, wooden pallets are, for example, either covered with metal profiles on the outer surfaces or formed entirely from metal profiles, which is not the case with plastic pallets. In this respect, the ends of the support skids of plastic pallets with the outer support feet arranged on them form weak points with a not inconsiderable risk of breakage if the lifting devices are actuated carelessly. This has led to the fact that plastic pallets in these areas are often provided with internal reinforcements made of hollow profiles, which, however, can ultimately also lead to damage on the upper deck when impact is initiated.

In the prior art, plastic pallets are known in which skids can be connected to the cover plate of the pallet by means of plug-in extensions and can be detachably fastened by means of latching elements, so that if skids are damaged, they can be completely replaced (DE 10 2014 219 398 AI). Furthermore, it is known (EP 2 722 285 AI) to provide pallets with rod-shaped stiffening elements in the skid area. For this purpose, the stiffening elements are inserted into recesses in the runner and fastened in plate form via lateral stabilizing elements which can be used in recesses in the runner. The attachment is done via locking hooks so that the stiffening elements of the skids can be replaced when worn.

These solutions are by no means satisfactory because they are either complex or can also damage the other areas of the pallet.

The object of the invention is to provide a simply constructed pallet which enables quick and easy replacement in the event of damage to the pallet. According to a further aspect, damage to the remaining pallet parts, in particular the upper deck, in the event of impact loads, in particular when lifting tines of lifting devices, should be avoided.

SUMMARY OF THE INVENTION

According to the invention, the multiple, usually three skids below the cover plate of the pallet are each subdivided into several skid elements, preferably each skid into two separate skid elements, which then form the skids in the assembled position on the pallet. As a result, in the event of careless handling of lifting devices and damage to the pallet that occurs, the part can be replaced easily, which on the one hand enables quick disassembly/assembly and also reduces the material consumption of plastic material. It is within the scope of the invention to subdivide all the skids of a pallet accordingly, but it may also be expedient to divide only those skids into several skid elements that are arranged in the area, for example, of the narrow side of a pallet, where as a rule damages can occur by prongs of lifting devices.

The skid of a pallet is expediently specially equipped for this purpose, namely in that the skid as such, in the assembled position, has support leg-like angled end sections at its two ends, which form the skid support members, which together with further support feet on the underside of the cover plate of the pallet, hold the skids at a distance to the underside of the cover plate and form between them or between themselves and the support feet on the underside of the cover plate of the pallet corresponding engagement openings for the engagement of tines of conventional lifting devices.

This means that the angled skid support members provided at the ends of each skid take on the function of conventional support feet on the underside of the cover plate of the pallet. The skid support members are expediently formed at the ends of the skid stand surface of the skid, on the underside of which the pallet rests on the floor after being turned off by the lifting device.

In a particularly expedient manner, the skids are divided into separate skid elements, in particular into a pair of skid elements, that is to say the skid is divided into two skid elements. The subdivision or partitioning is expediently carried out in the area of the skid base, two skid elements in particular being formed in the case of a central skid division. In the assembled position, these complement each other, possibly including the underside of a support leg of the pallet, to form a continuous skid base.

The skid is expediently releasably connected to the cover plate via the skid support members, the free end of each runner element which is opposite the corresponding skid support member advantageously being releasably connected to a support foot of the cover plate. If there is damage in a skid area, for example due to careless handling of lifting devices, then it is not necessary to replace the entire skid, but rather only the damaged part of the skid in the form of a separate skid element.

According to a further development of the invention, the skid is divided transversely to the runner stand surface into at least two, but preferably two skid elements, in particular into two L-shaped skid elements, the L-leg being formed by the skid support members and the L-web by the corresponding skid stand surface of the skid element. The fact that the skid support members are expediently designed to be identical to one another results in a flush design of the skid base surface, in particular the underside thereof, after assembly of the skid elements.

The skid elements each forming a skid can be releasably connected to the cover plate via their skid support members by a form-fitting plug-in connection and/or, if appropriate, a latching connection. A combination of a form-fitting plug-in connection and a locking clip is also expedient, which enables quick disassembly/assembly. At the end of each skid element opposite the skid support member, a snap lock can be provided, via which the skid element can be detachably connected to a support foot at this end. However, this connection is preferably made by a separate mechanical fastening means. Quick-release screw bolts with a quick thread or, in particular, bolts with a bayonet lock are suitable for this.

With these fasteners, it is expedient that the bolt head being usually broader in radial direction is received in a recess in the cover plate flush with the surface of the cover plate and the bayonet lock or screw lock of the bolt interacts with the skid base surface for the purpose of locking. In the same way, however, an inverted design is also possible, that is to say anchoring the bolt head from the underside of the skid base surface with countersinking in the skid base surface and fixing the bolt in the region of the cover plate. Both variants are useful.

In a particularly advantageous manner, in particular in the case of a split of a skid into two skid elements, it is expedient that the ends of the skid elements opposite the skid support member, which lie against each other in the assembled position to form the skid, are provided, with mutually offset, complementary and in particular annular receiving flanges for the fasteners. As a result, the ends of the skid elements engage in one another in the assembled position, that is to say the receiving flanges of the two skid elements lie one above the other, so that both skid elements can be anchored or fastened to the cover plate with one and the same fastening means. As a result, the skid is fixed, so to speak, in the middle region, that is to say in the middle region of the skid stand surface, by means of a fastening means on the cover plate, in addition to the form-fitting and/or snap-in connection via the skid support members provided at the other ends of the skid elements. This has a very favorable effect for quick and easy disassembly of damaged components and assembly of replacement components.

Each skid element is preferably connected to the cover plate by means of a positive fit with the cover plate, the hold of the skid element expediently taking place via a shoulder part spanning a recess for engagement with the skid support member, in which the skid support member is preferably held only by a plug-in connection, in particular a form-fit connection. The skid element can then be mechanically fixed at the other end by a mechanical fastening means.

In an alternative embodiment, however, it is also expedient for the ends of each skid element opposite the skid support members to be connected and fastened separately to one another on a support foot with the cover plate by means of a fastening means. Although two fastening means are then required, this has the advantage that the skid elements can be made identical to one another overall, that is, only one and the same L-shaped skid element is required. In this embodiment, the support base of the cover plate, which is generally arranged in the center, advantageously contributes with its underside to the formation of the continuous skid.

In both cases, it is expedient if the ends of the skid elements which are fastened to the support feet engage or are arranged in complementary recesses in the support feet, so that a flush arrangement on the underside of the pallet can be ensured in a simple manner.

For the quick connection of the skid elements, it is expedient that the skid support members can be positively fitted into a complementarily shaped recess on the cover plate. A clip-like snap lock can also be expediently provided, but this is not mandatory.

As a rule, the pallets are provided with three support feet per skid area, two of the support feet being formed by the skid support members in accordance with the invention. In this respect, the ends of the skid elements opposite the skid support members are expediently attached to the support foot, which is arranged in the center of the cover plate, using a mechanical fastening means. For assembly, each L-shaped skid element is arranged obliquely to the underside of the cover plate and then pivoted downwards, so that the clip-like locking or the form-fitting fit of the skid support members takes place on the cover plate and after that, after swiveling the skid elements in the direction of the cover plate the locking takes place via the mechanical fastening means.

In a particularly advantageous development of the invention, the skid elements are stiffened. A fiber-reinforced plastic material is suitable for this, for example by embedding carbon or glass fibers, or else the embedding of rigid stiffening elements, for example in the form of steel inserts or the like. Advantageously, in the context of the invention, the cover plate with the support feet, in particular in the center, and also the separate skid elements are each produced in one piece by injection molding from plastic.

The term "pallet" used herein and in the claims is to be understood very broadly within the meaning of the invention and denotes a load carrier, which in a preferred case is formed from only a pallet with a flat and side wall-free cover plate but can also be a load carrier with the pallet as a lower part and thus as part of a large load carrier or bulk container in which the pallet is integrated. In this case of a load carrier forming such a large container side walls extend from the cover plate, which then forms the bottom part of this container, which side walls are arranged all around. This can be a rigid, that is to say a non-foldable side wall structure, in which a hinged cover can optionally be provided in at least one side wall, or the side walls are hinged directly to the cover plate or to frame members arranged thereon via hinges and the like. To this extent, the term "pallet" encompasses such load carriers, which are intended in particular for the reception of piece-like goods.

In a special development of the invention, the pallet as the load carrier forms the base part or the substructure of a large container, also called a large load carrier, with which the load carrier stands on the floor, whereas the containers are used in particular to hold lumpy goods. These large containers, also known as large load carriers or bulk containers, are constructed like containers and have the usual standard dimensions in length and width of containers from about 800 mm×600 mm upwards and often have pallet dimensions in the base area. In this embodiment, the pallet according to the invention then forms, so to speak, the load carrier due to an additional wall structure, the cover plate of the pallet forming the base part of the large container or bulk containers. It is expedient to arrange the side walls of the large container on the cover plate of the pallet, which then forms the bottom part of the container, in particular to fix it in an articulated manner, which enables the side walls to be folded to form a folding container. This gives the advantage of this special pallet design with regard to the replacement of damaged components even for pallet-like bottom parts of large containers or bulk containers.

BRIEF DESCRIPTION OF THE DRAWINGS

Exemplary embodiments of the invention are described purely schematically below with reference to the drawings.

DETAILED DESCRIPTION OF THE PREFERRED EMBODIMENT

Figure 1:
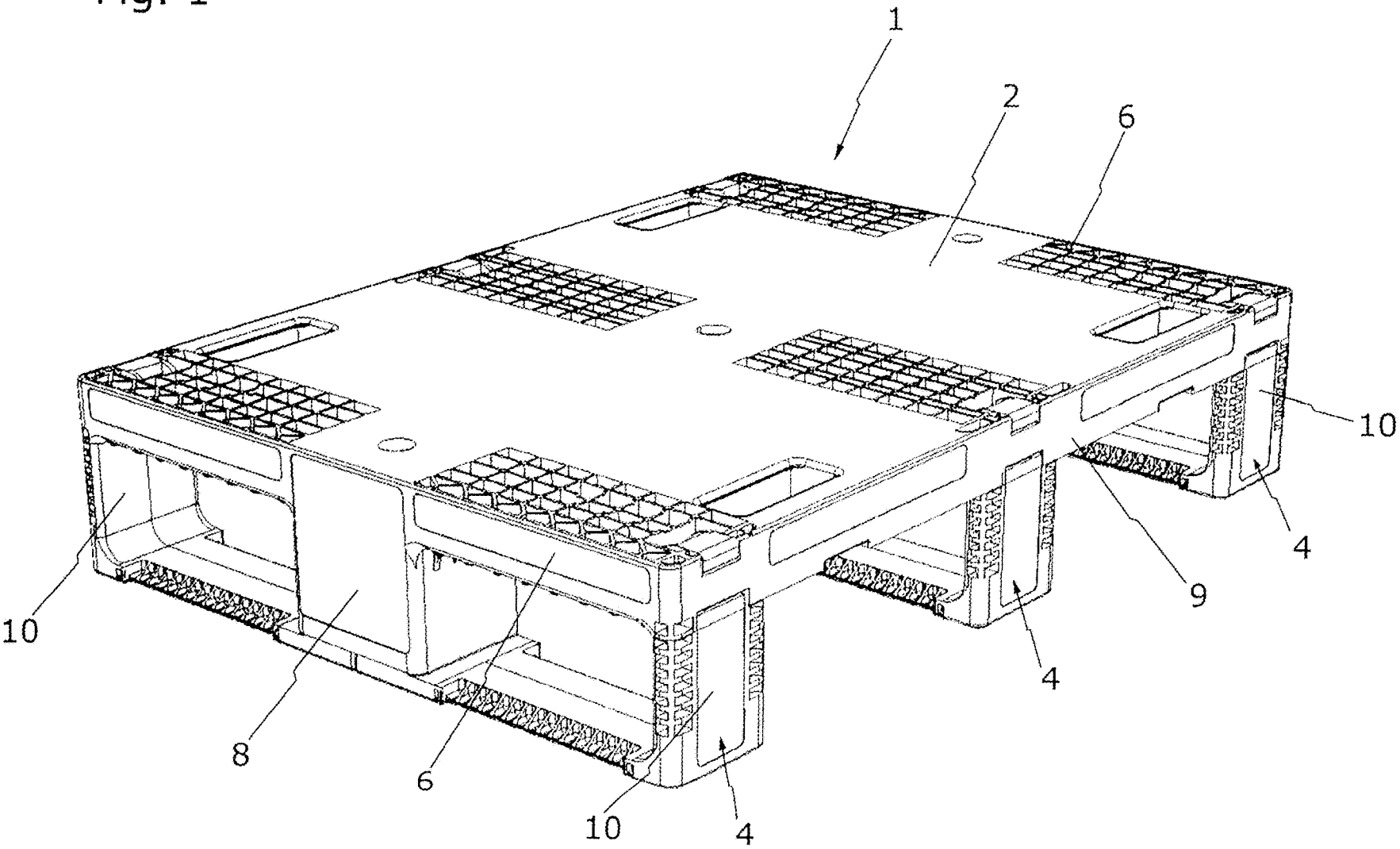
FIG. 1 is a perspective view of an embodiment of a pallet according to the invention (viewed from above)

FIG. 1 shows an embodiment of the pallet according to the invention in a view from above, the pallet 1 having a cover plate 2 with a flat support surface, which is used for the transport of products and goods. In the exemplary embodiment shown, the pallet 1 further comprises three skids 4, here in an identical design to one another, which are arranged parallel to one another and parallel to a side edge and thus, due to the rectangular plan, parallel to the two opposite side edges 6. In the exemplary embodiment shown, the side edges 6 are the edges of the narrow side of the pallet.

It is only a so-called half-pallet, which is very common on the market and—again only by way of example—has a pallet size of 800×600 mm here for the purpose of illustration. Of course, the invention is also applicable to any other standard sizes.

Figure 2:
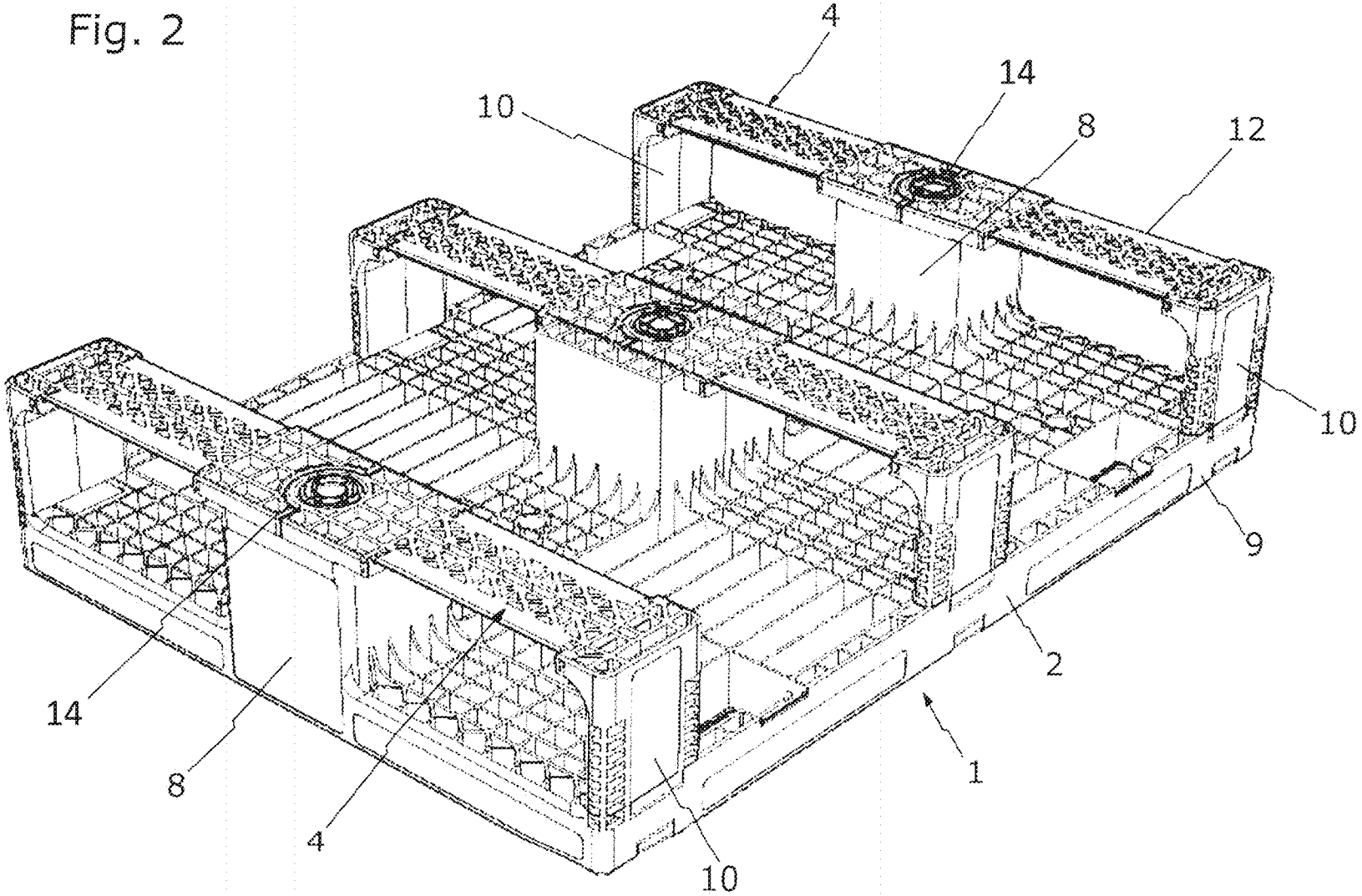
FIG. 2 is a perspective view of the pallet seen from the bottom.

As can be seen from FIG. 2, the pallet has in particular three support feet 8 arranged centrally, that is to say along a central longitudinal axis of the pallet, by means of which the distance between the lower part of the skids 4 and the pallet ceiling, that is to say the cover plate 2 of the pallet 1, is fixed. The skid 4 has at both of its opposite ends an angled, in particular right-angled skid support member 10, which is designed like a support foot and is arranged at a distance from one another in series at the longitudinal edges 9 of the pallet 1. These skid support members 10 also determine the distance between the lower part of the skid 4 and the underside of the cover plate 2 of the pallet 1. As clearly shown in FIG. 2, the skid 4 has an elongated, strip-like skid stand surface 12 which has an underside at the top in FIG. 2 due to the upside-down representation, with which the pallet normally rests on the ground in the correct direction of rotation. The underside is not assigned a reference number here.

As can be clearly seen from FIG. 1, the two skid support members 10 of each skid 4 arranged on the narrow side, with the centrally arranged support foot 8 between them, delimit an engagement opening which is used for retracting tines of conventional lifting devices, such as forklifts or pallet trucks or Hand pallet truck. This allows the tines to be inserted from the narrow side accordingly.

Corresponding engagement openings are, however, also provided on the longitudinal edges 9 of the pallet, the skids 4 delimiting two engagement openings for lifting devices between them in the exemplary embodiment shown.

Figure 3:
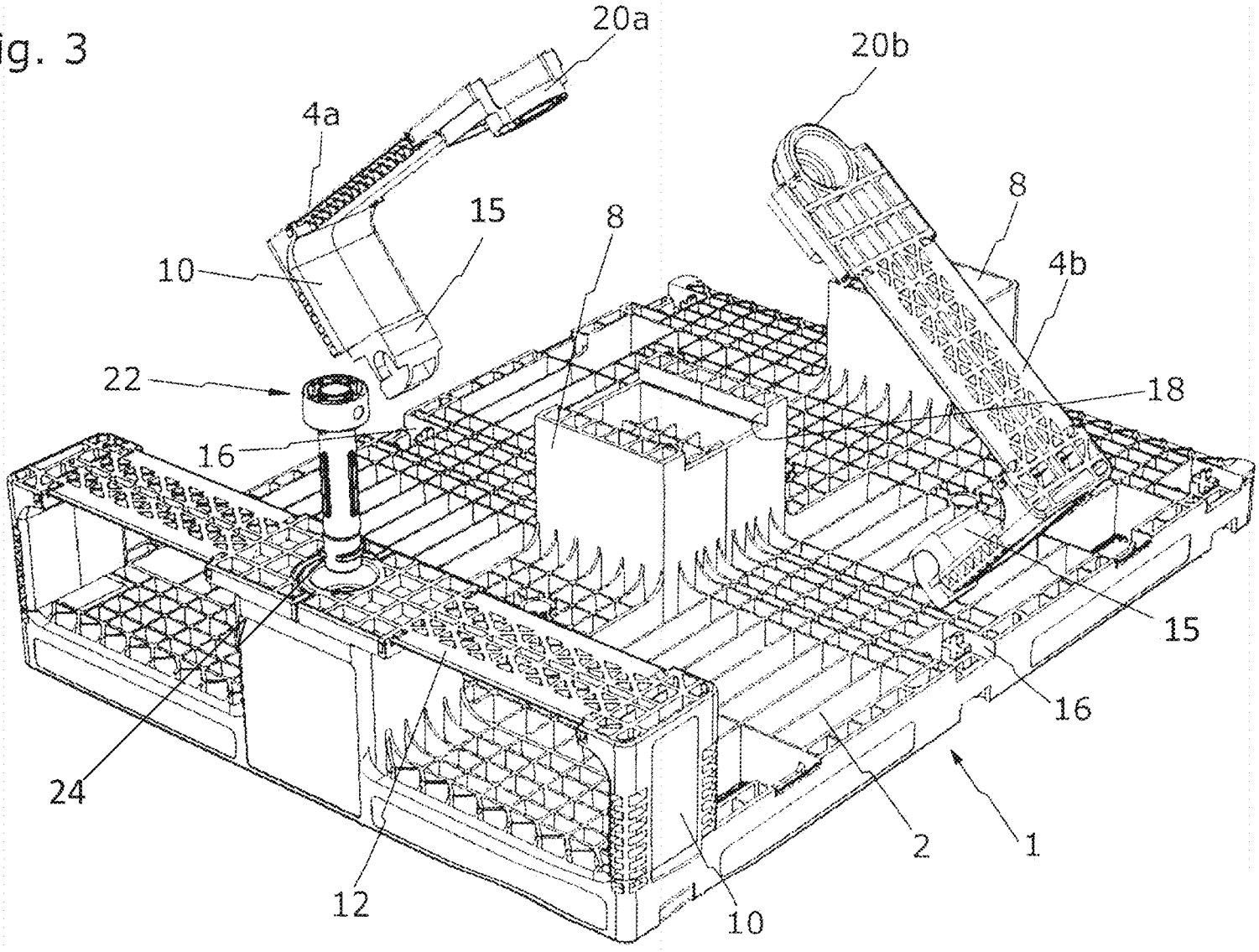
FIG. 3 shows a view of the pallet according to FIG. 2, but in the functional position of individual components.

In the embodiment according to FIG. 2, each skid 4 is advantageously divided into two skid elements 4*a* and 4*b* in the middle of the skid stand surface along a transverse dividing plane 14, as can best be seen in FIG. 3. Each of these skid elements is L-shaped, namely from half a length of the skid stand surface and the angled skid support member 10. At the free end of the skid support member 10 there is a projection 15, which can preferably be positively fitted into a complementary recess 16 on the underside of the cover plate 2 and expediently, but not necessarily, releasably fastened by means of a suitable, in particular clip-like latching connection.

As can be seen from FIG. 3, each skid element can be attached obliquely to the underside of the cover plate so that the projections 15 can engage in the corresponding recesses 16. Thereupon each skid is pivoted in the direction of the corresponding middle support leg 8 and expediently engages there with its skid stand surface in a corresponding complementary recess 18 of the middle support leg 8. With the pivoting of the skid element 4*a* and 4*b* in the direction of the recesses 18, in the case of latches, the latching nose formed by the projection 15 automatically snaps into a corresponding latching recess means of the underside of the cover plate in the region of the recess 16, so that the free end of each skid support member 10 can be locked to the underside of the cover plate 2.

The pivoted-in position for the front skid is presented in FIG. 3. Here, at the free ends of the skid elements, flange shaped, annular recesses 20*a* and 20*b*, which are offset from one another and are offset from one another, lie coaxially on one another at the free ends of the skid elements, so that there is an overall flush underside of the skid stand surface 12 of each skid 4 (cf. FIG. 4, foremost skid). In this position, in which the free ends of the two skid elements 4*a*, 4*b* are arranged opposite one another and expediently abutting one another, the flange-like recesses 20*a*, 20*b* lie one on top of the other in a coaxial orientation, so that a suitable mechanical fastening means can be introduced, which extends through a corresponding opening in the support leg 8 and is releasably attachable in the area of the upper deck or the skid by means of appropriate fastening facial expressions, which is not shown. As FIG. 3 shows, a bolt 22 is suitable as the fastening means, which is provided with a bayonet lock 24, shown here as bayonet thread sections. The bolt 22 has a radially widened bolt head at the other end. Such bayonet bolts are known and need not be described in detail. In the embodiment according to FIG. 3, the bayonet bolt 22 is inserted from the underside, but a reverse arrangement is also expedient in that the bolt can be inserted into a corresponding receptacle from the top of the cover plate 2 and then the bayonet mimic on the bolt can engage with a corresponding bayonet mimic approximately in the ring flange 20*b* of the skid element which, in the illustration shown in FIG. 3, rests coaxially from above on the annular receiving flange 20*a*. In both cases, both skid elements are releasably locked to the upper deck by means of a bolt, here in the area of the central support leg.

Obviously, in the event of damage to a skid element, it can be exchanged quickly and easily for an undamaged new skid element. It is only necessary to open the bayonet catch, remove the bolt and then swing the corresponding skid element upwards as shown in FIG. 3, so that the free end of the skid support member is unlocked from the upper deck and the damaged skid element can be removed and replaced with a new one.

It goes without saying that the projection 15 is designed with the latching mechanism in each case such that it can be fitted flush into the recess 16 on the underside of the cover plate and thus is flush with the outside and the underside of the cover plate. This can be seen very clearly from FIG. 1.

Figure 4:
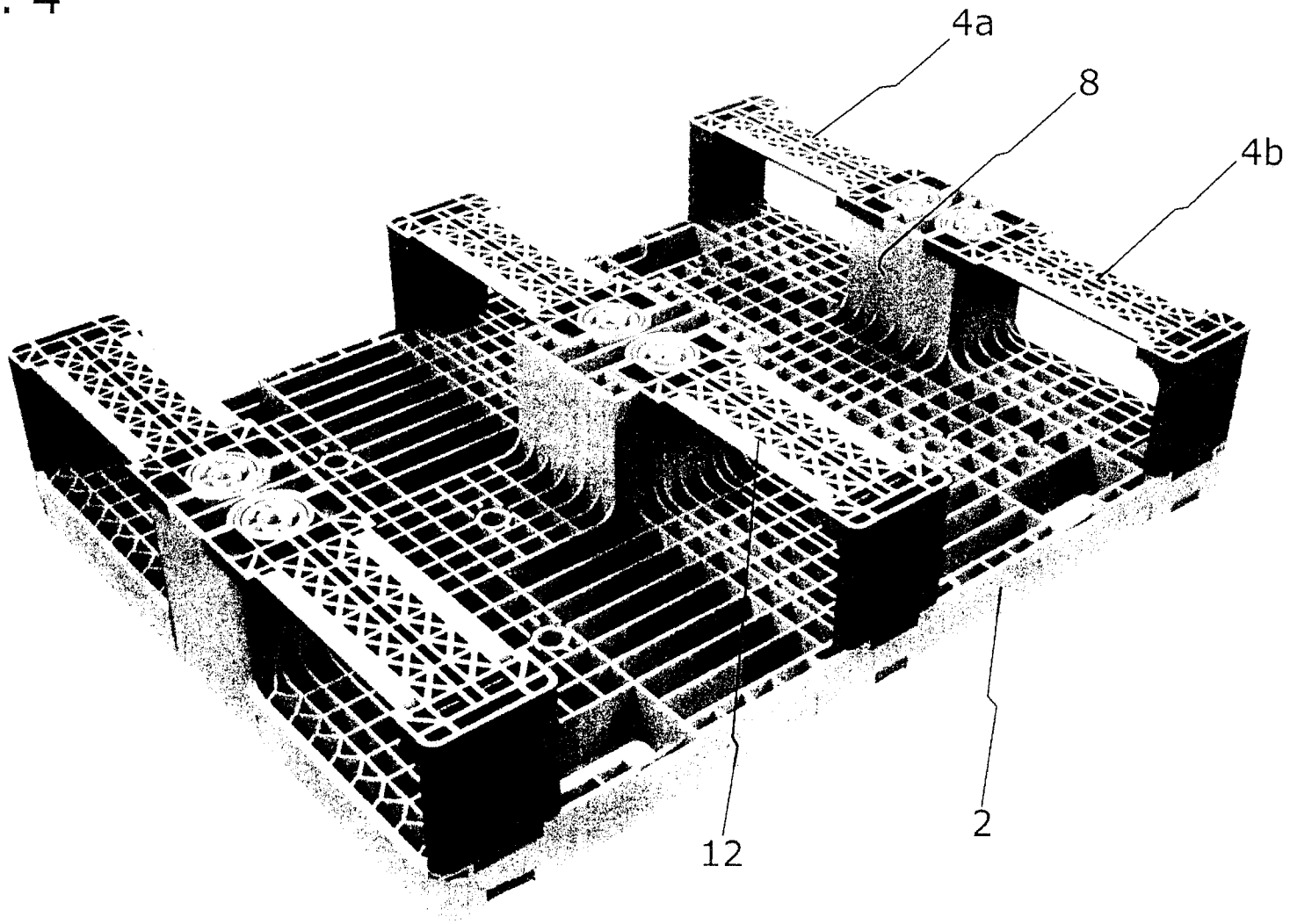
FIG. 4 shows a perspective view of a pallet in accordance with a further embodiment (view from above)

FIG. 4 shows a further embodiment of the invention, in which each of the L-shaped skid elements 4*a*, 4*b* with the respective central support foot of the cover plate 2 separately by a mechanical fastening means, here again expediently by a corresponding bayonet locking bolt, as shown in FIG. 3, is releasably lockable. The form-fitting and/or latching connection of the skid support members corresponds to that of the embodiment according to FIGS. 1 to 3, so that it does not have to be described again here. The other components also correspond to those of the previously described embodiment. As shown in FIG. 4, after the two skid elements 4*a*, 4*b* have been swiveled in, the bottom of the skid 4 is again aligned flush, so that under inclusion of the bottom of the central support leg formed on the underside of the cover plate, there is a quasi-closed, continuous skid stand surface 12 results. This embodiment has the advantage that, unlike in the case of the previous embodiment, a uniform skid element can be used for all six skid elements.

Figure 5:
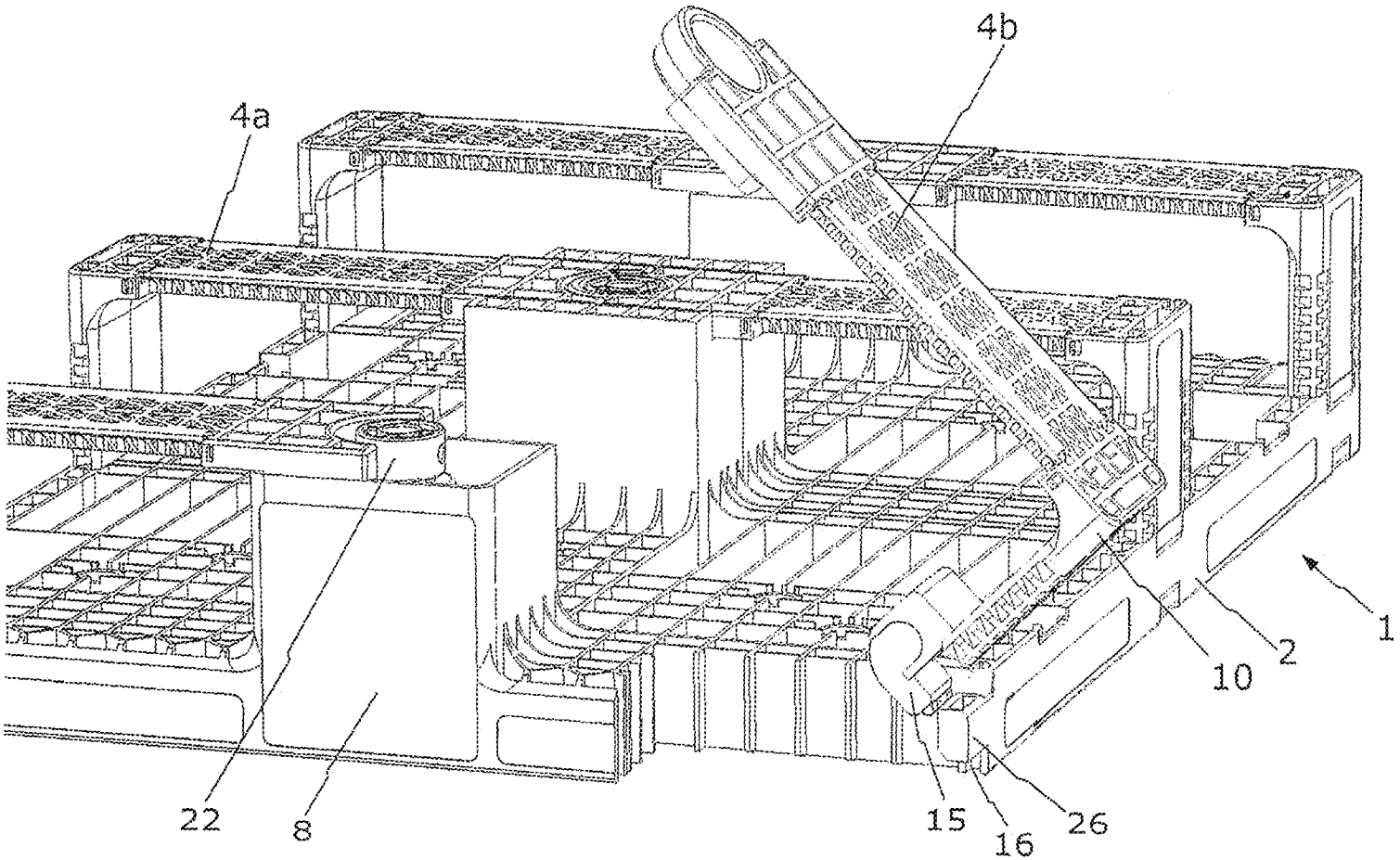
FIG. 5 is a partial perspective view of the embodiment of FIGS. 1 to 3 showing the attachment of a skid element to the cover plate.

FIG. 5 shows a detailed view of an attachment of the ends of the skid elements 4*a*, 4*b* to the cover plate 2 of the pallet 1, specifically by way of example using the embodiment according to FIGS. 1 to 3, but also the attachment of the ends of the skid elements shown in FIG. 5 is equally applicable to other embodiments, in particular the embodiment according to FIG. 4.

According to FIG. 5, the skid elements 4*a*, 4*b* are provided at their outer ends, namely at the ends of the angled skid support members 10 with an outwardly directed projection 15 which is designed as an outwardly projecting tongue and, in the exemplary embodiment shown, extends preferably parallel to the skid base surface of the skid elements extends. In the exemplary embodiment shown, the projection 15 is part of a flange part 24, which is formed on the inside of the skid support member 10 and is L-shaped. The projection 15 interacts with a recess 16 in the cover plate 2, into which it can be inserted. Recess and projection 15 are formed complementary, so that there is a positive connection. Here, as can be clearly seen from FIG. 5, the projection 15 engages under a shoulder part 26 provided on the recess 16. In the exemplary embodiment shown, the shoulder part 26 bridges the recess 16, but can also be designed continuously or in the manner of projecting stubs on the side surfaces of the walls of the recess. In any case, the shoulder part 26 in the plug-in position of the projection 15 in the recess 16 prevents the skid element finally fastened via the fastening element in the middle pallet area, here the skid element 4*b*, from being able to move out of the recess, rather the skid element in the functional position as a skid is fixed and positively caught within the recess 16, so that it is only fastened at the opposite end, that is to say in the region of the centrally arranged support feet 8 of the skid element, in each case by means of the corresponding fastening means, in particular a bolt 22. In this respect, only one-sided fixing of the skid elements at one end by a separate fastening means is required in order to firmly fasten the skid element and thus the skid 4 to the cover plate 2 to form the lower part of the pallet. This enables a quick change of a damaged skid or a damaged skid element.

Figure 6:
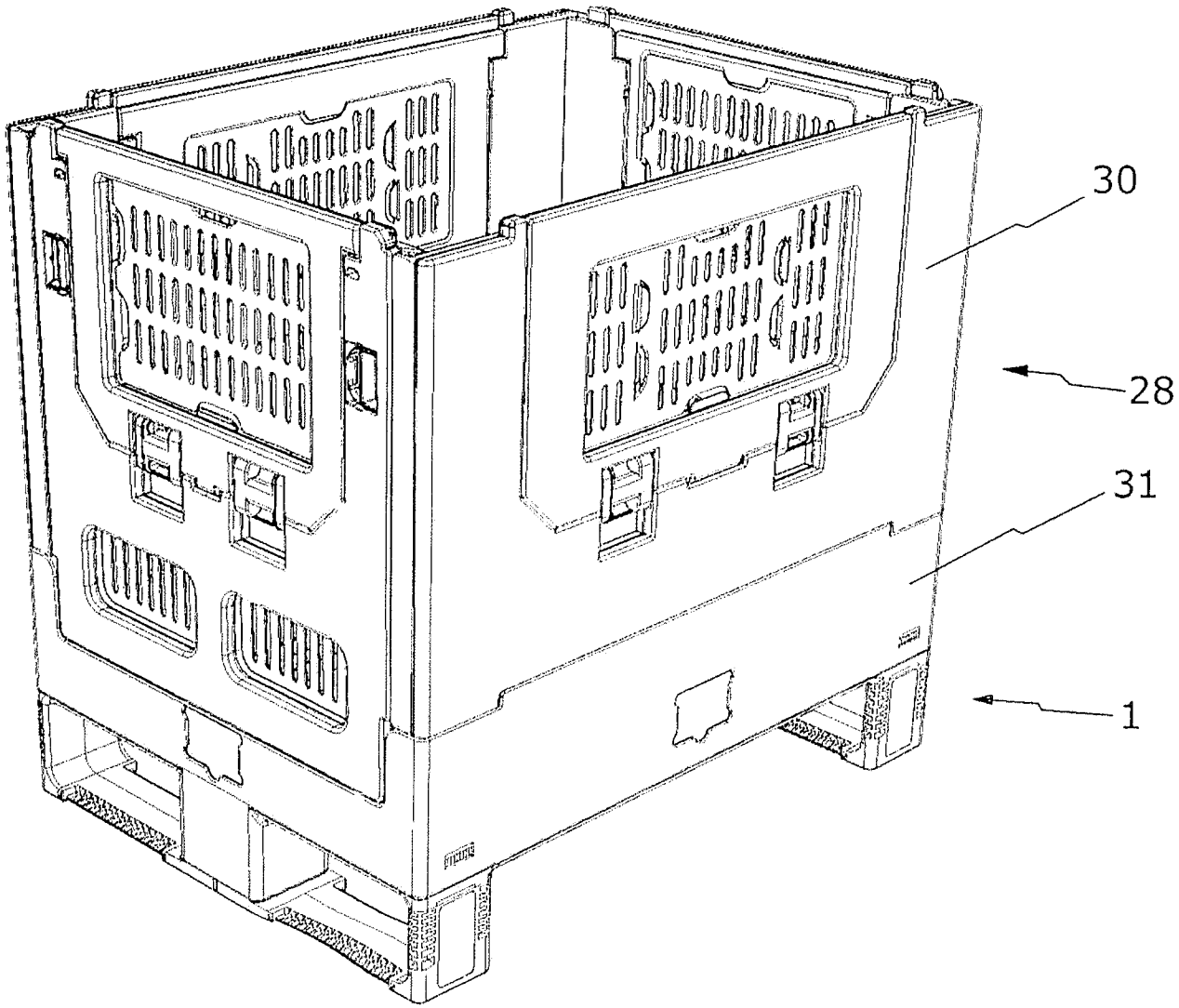
FIG. 6 is a perspective view of the pallet in the form of a bottom part of a large container or bulk container.

FIG. 6 shows the use of the pallet 1 as the base part of a large container 28, the side walls 30 of the large container being preferably foldably connected to the corresponding sides of the cover plate 2 and thus, as it were, the pallet. This means that the special design of the pallet with the interchangeable skid elements is also corresponding and analogous for large containers or bulk container applicable. These large containers are generally known and have a pallet-shaped bottom part, on which the side walls 30 are arranged and mostly foldable. In the exemplary embodiment shown, the side walls are preferably arranged on frame members 31 of the base part designed as a pallet 1, and in particular in a hinged manner. The frame members 31 are preferably arranged all around the pallet. In the illustrated embodiment, the frame members 31 are part of the pallet, but this is not mandatory. They could also be connected separately to the bottom part of the pallet 1 by a snap-in or plug-in connection, but they protrude all the way up from the bottom part. From the bottom part to the upper edge of the side walls 30, the height of such large containers usually is in the range from 80 to 110 cm, so that a large-volume storage space is possible for accommodating, in particular, lumpy goods. These large containers have standard pallet-like dimensions.

Figure 7:
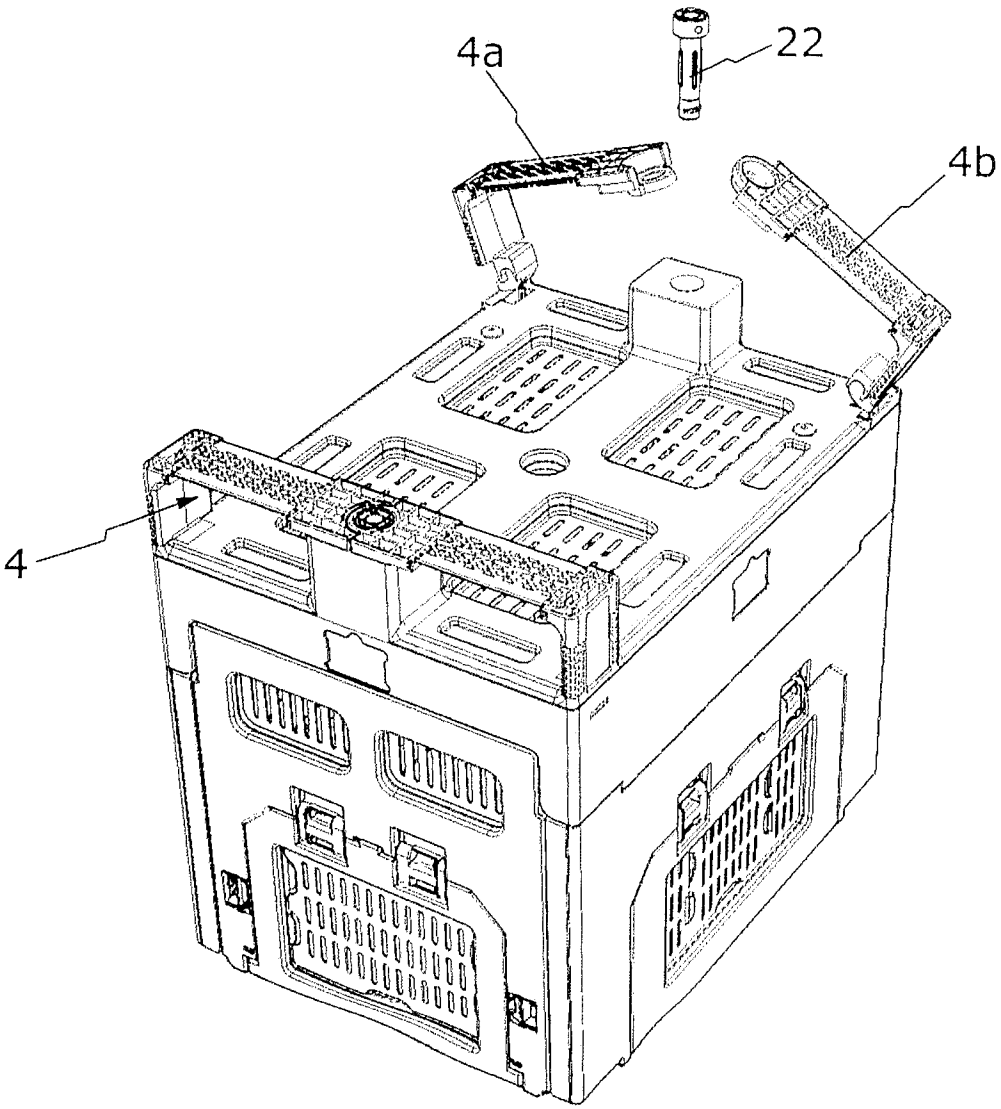
FIG. 7 is an illustration of the embodiment of FIG. 6, but in the functional position and in the reverse position, i.e. with the bottom part arranged above.

FIG. 7 shows the large container with the bottom up, so that the skids 4 can be seen. In the exemplary embodiment shown, the base part of the pallet 1 corresponds to the exemplary embodiment in FIGS. 1 to 3, a pallet according to the embodiment in accordance with FIG. 4 being equally applicable. The bottom part of the large container forms, so to speak, the pallet 1 with the lower part in the form of skids, so that the pallet shown in FIGS. 1 to 4 can be used as the bottom part of a large container.

As can be seen from FIGS. 6 and 7, in this exemplary embodiment the large container is only equipped with two skids 4, but this is only an example. If necessary, depending on the size of the large container, a middle skid can also be provided as in the embodiments according to FIGS. 1 to 4.

The invention claimed is:

1. A pallet, comprising:

a cover plate configured to hold objects; and at least two skids arranged below the cover plate which are arranged parallel to each other and parallel to a pallet edge and each with a skid standing surface configured to abut a ground surface, at the ends of which a support leg-like skid support member angled from the skid standing surface in an upward direction of the cover plate is arranged, the skid standing surface being spaced apart from the cover plate by the skid support members and support feet arranged therebetween; and wherein the at least two skids are each formed from at least two, one-piece skid elements, such that each skid element is L-shaped and such that the skid support member of each skid element each formed at an end of the skid elements is angled at right angles from the skid standing surface of the skid element, wherein the skid elements are each releasably connectable to the cover plate and which cooperate to form a skid of the pallet in the position mounted on the cover plate, and wherein the pallet comprises plastic.

2. The pallet according to claim 1, wherein the skids are divided transversely in the skid stand surface for forming the at least two skid elements, and wherein a skids-mounted position of the cover plate, the underside of the at least two skids stand surfaces of both skid elements complement each other to form a skid standing surfaces that is flush on an underside.

3. The pallet according to claim 1, wherein the skid elements are configured to be detachably connected to the cover plate of the pallet via the skid support members by a positive plug-in connection and/or a clip-like latching connection and an end opposite the skid support member is connected to a support foot by a snap lock or by at least a separate mechanical fastener.

4. The pallet according to claim 3, wherein the fastener includes a bolt with a bayonet locking mechanism, a bolt head being received flush in a recess in a skid base surface and the bayonet locking of the bolt is configured to be locked with the cover plate.

5. The pallet according to claim 3, wherein the fasteners are formed by bolts with a bolt head designed with a larger radius than the bolt diameter and with a bayonet lock or screw lock formed on the end opposite the bolt head.

6. The pallet according to claim 1, wherein the ends of the at least two skid elements are opposite one another in a mounted skid position and are provided with complementary ring-shaped receiving flanges offset in height from one another for the fastener, wherein bayonet bolts, which are arranged one above the other in an assembled position in such a way that undersides of the skid base surfaces of the at least two skid elements are flush, and wherein at least two opposite skid elements are configured to be releasably locked to a support foot by the bayonet bolt.

7. The pallet according to claim 1, wherein the ends of the at least two opposing skid elements in an assembled skid position are configured to be releasably lockable separately with a support foot using a bayonet bolt.

8. The pallet according to claim 7, wherein in an assembled position of at least two opposing skid elements whose ends are received in complementary recesses on the underside of the support foot such that the undersides of the skid stands and the corresponding support feet are flush with each other.

9. The pallet according to claim 1, wherein the free ends of the at least two skid elements are configured to be positively fitted in a complementary recess on the cover plate and/or are configured to be locked with the latter by a clip-like latching closure, and wherein the releasable connection between the skid element and the cover plate includes pivoting the skid element to the cover plate.

10. The pallet according to claim 1, wherein in the case of a pallet with support feet arranged in a middle of the pallet, each skid is divided in a middle and both ends of the skid base surfaces of both skid elements are configured to be locked with a support stand arranged in the center by one or two bayonet bolts.

11. A pallet according to claim 1, wherein the at least two skid elements are stiffened by fiber-stiffened plastic material and/or by embedding rigid and/or steel bars.

12. A pallet according to claim 1, wherein the skid support members with adjacent support feet or adjacent skid support members form engagement openings for prongs of lifting devices.

13. The pallet according to claim 1, wherein the at least two skids include three skids which include engagement openings for the prongs of lifting devices between them, and wherein each skid formed from two skid elements has two opposite skid support members and in a middle of the skid in each case a support foot formed on an underside of the cover plate is arranged, the skid support members, with the central support foot of the cover plate of the pallet, delimiting corresponding engagement openings for prongs of lifting devices.

14. The pallet according to claim 1, wherein the cover plate with support feet and the skid elements is formed in one piece by injection molding of the plastic.

15. The pallet according to claim 1, wherein the skid support members of the skid elements are positively fixed via projections to the cover plate by engagement in recesses, the projections of the skid elements fixed by a shoulder part such that the skid elements are mechanically attachable only on their ends via quick-release elements.

16. The pallet according to claim 1, wherein the pallet forms the substructure of a large load carrier which has a side wall structure with circumferentially arranged side walls, of which at least one side wall is configured to be foldable inwards.

17. A pallet according to claim 16, wherein the pallet forms the bottom part of the large load carrier with its cover plate, whereas side walls or lower frame elements of the large load carrier are pivotably connected with edge sides or edge regions of the cover plate of the pallet.

18. A large load carrier with a base part and a side wall structure, wherein the large load carrier includes a base part which is formed by a pallet according to claim 1.

* * * * *